US012708224B2

(12) United States Patent
Nieuwlaat et al.

(10) Patent No.: US 12,708,224 B2
(45) Date of Patent: Aug. 18, 2026

(54) REFRIGERATOR APPLIANCE

(71) Applicant: ILLINOIS TOOL WORKS INC., Glenview, IL (US)

(72) Inventors: Jos Nieuwlaat, Etten-Leur (NL); Joannes Sebastiaan Cornelis Emmen, Etten-Leur (NL)

(73) Assignee: ILLINOIS TOOL WORKS INC., Glenview, IL (US)

( * ) Notice: Subject to any disclaimer, the term of this patent is extended or adjusted under 35 U.S.C. 154(b) by 123 days.

(21) Appl. No.: 18/777,651

(22) Filed: Jul. 19, 2024

(65) Prior Publication Data

US 2025/0024966 A1 Jan. 23, 2025

(30) Foreign Application Priority Data

Jul. 19, 2023 (GB) ..... 2311021

(51) Int. Cl.

| | |
|---|---|
| ***A47F 3/06*** | (2006.01) |
| ***A47F 3/04*** | (2006.01) |
| ***F25D 23/06*** | (2006.01) |
| ***F25D 25/02*** | (2006.01) |

(52) U.S. Cl.

CPC ..... *A47F 3/06* (2013.01); *A47F 3/0426* (2013.01); *F25D 23/067* (2013.01); *F25D 25/02* (2013.01); *F25D 2325/021* (2013.01)

(58) Field of Classification Search

CPC ..... A47F 3/06; F25D 23/067; F25D 25/02; F25D 2323/06; F25D 2325/021

See application file for complete search history.

(56) References Cited

U.S. PATENT DOCUMENTS

| | | | | |
|---|---|---|---|---|
| 3,266,858 | A | 8/1966 | Klotz | |
| 3,797,903 | A * | 3/1974 | Traulsen | F25D 25/02 108/147.15 |
| 5,642,924 | A * | 7/1997 | Wohlrab | A47B 57/16 211/134 |
| 5,645,182 | A * | 7/1997 | Miller, Jr. | A47F 5/12 211/175 |
| 5,893,620 | A * | 4/1999 | Birgelis | F25D 23/067 312/334.44 |
| 6,238,032 | B1 * | 5/2001 | Cooper | A47B 57/10 312/351 |
| 7,533,948 | B2 * | 5/2009 | Smith | F25D 25/02 211/187 |
| 9,357,840 | B2 * | 6/2016 | Davis | A47B 91/00 |
| 10,827,833 | B2 * | 11/2020 | Romantic | A47B 57/545 |

(Continued)

FOREIGN PATENT DOCUMENTS

| | | | |
|---|---|---|---|
| CA | 772057 | A | 11/1967 |
| KR | 19990000954 | U | 1/1999 |

(Continued)

*Primary Examiner* — Daniel J Rohrhoff

(74) *Attorney, Agent, or Firm* — THOMPSON HINE LLP

(57) ABSTRACT

A refrigerator appliance includes a cabinet with a rear side and a door opposite the rear side at a front of the cabinet. A panel is disposed at the rear side of the cabinet and includes an integrally moulded first shelf support for supporting a rear end of a shelf. A second shelf support is spaced from the first shelf support and arranged to support a front and/or side of the shelf. The second shelf support includes a rail having a plurality of attachment positions for a clip to support the shelf.

19 Claims, 6 Drawing Sheets

(56) References Cited

U.S. PATENT DOCUMENTS

| | | | | |
|---|---|---|---|---|
| 2013/0160483 | A1* | 6/2013 | Hasturk | A47B 96/1458 312/404 |
| 2014/0055017 | A1* | 2/2014 | McMillin | A47B 97/00 211/134 |
| 2018/0100687 | A1* | 4/2018 | Ammerman | F25D 23/066 |
| 2018/0127150 | A1* | 5/2018 | Adanur | B65D 21/0215 |
| 2018/0216874 | A1* | 8/2018 | Pinheiro | F25D 23/04 |
| 2018/0363974 | A1* | 12/2018 | Costa | F25D 23/069 |
| 2022/0074646 | A1* | 3/2022 | Jin | A47B 57/34 |
| 2024/0328706 | A1* | 10/2024 | Bianchezzi | F25D 17/062 |

FOREIGN PATENT DOCUMENTS

| | | | |
|---|---|---|---|
| KR | 20040065368 | A | 7/2004 |
| WO | 2007033962 | A1 | 3/2007 |
| WO | 2013164176 | A2 | 11/2013 |

* cited by examiner

REFRIGERATOR APPLIANCE

TECHNICAL FIELD

The invention relates generally to a refrigerator appliance.

BACKGROUND

Refrigerator appliances are commonly used to store products such as food and beverages. They are provided with one or more cabinets in which shelves are arranged to store and to place the products for display.

FIG. 1 shows a refrigerator appliance 2 with a frame 4 that houses two cabinets 6,12 with respective doors 8,14. The frame also houses a technical cabinet 22 that accommodates the condenser and compressor, and may additionally accommodate the expansion valve. The cabinets 6,12 have a shared interior that includes a shelving unit including shelves 18 that are arranged in multiple layers. The shelves 18 are fastened in place at the corners along rails 16 using fasteners or clips, at the front of the cabinet 6,12 and at the back of the cabinet 6,12.

Installing shelving units in such a refrigerator appliance is time-consuming and difficult because the fasteners or clips have to align precisely with the holes provided in the rails. This is especially difficult in for attaching the shelves to the rails at the back of the cabinet, as the area is hard to see and reach. The installation of the shelving unit requires many components to be assembled, which increases assembly time, and takes up the available storage space within the cabinet.

It would be desirable to provide a refrigerator appliance that addresses the above problems. Particularly, it is an object of the invention to provide a refrigerator appliance that simplifies and reduces the time required for the installation of shelves. It is another object of the invention to reduce the number of components required for installation, and to maximise available space for storing and displaying products within the refrigerator appliance.

The present invention provides at least an alternative to refrigerator appliances of the prior art.

SUMMARY

According to an aspect of the present invention, there is provided a refrigerator appliance, comprising:

- a cabinet comprising a rear side and a door opposite the rear side at a front of the cabinet;
- a panel disposed at the rear side of the cabinet and comprising an integrally moulded first shelf support for supporting a rear end of a shelf; and
- a second shelf support spaced from the first shelf support and arranged to support a front and/or side of the shelf, wherein the second shelf support comprises a rail having a plurality of attachment positions for a clip to support the shelf.

Thus, the rear end of the shelf can be supported directly by the integrally moulded shelf support in the panel at the back, instead of using fasteners or clips to attach the panel to a frame structure. This increases the available space within the refrigerator appliance for storing and displaying products. Advantageously, the position of the panel can be adjusted at the front by the rail and clip arrangement, further simplifying shelf installation. The refrigerator appliance of the present invention reduces the time required for installing shelves within the refrigeration cabinet and simplifies the installation process. This is because the number of components required is reduced, and the need for fastening clips or fasteners at the back of the cabinet is removed.

In examples, the first shelf support comprises a plurality of integrally moulded support surfaces. In examples, the heights of the support surfaces of the first shelf support correspond to the attachment positions of the second shelf support. This allows shelves to be supported by the first and second shelf supports, to position the shelves horizontally.

In examples, adjacent support surfaces are spaced apart by a recess shaped and sized for receiving the shelf. In examples, the recess extends upwards, towards the top of the cabinet. This advantageously decreases the space required at the front for installing shelves because the shelves can be inserted from the front of the door, from the top in a downwards direction.

In examples, the second shelf support comprises a first rail having a plurality of attachment positions for first clip attachable to one of the plurality of attachment positions of the first rail. For example, the rail may be the first rail.

In examples, the second shelf support comprises a second rail having a plurality of attachment positions and a second clip attachable to one of the plurality of attachment positions of the second rail.

In examples, the second shelf support comprises a first rail having a plurality of attachment positions for a first clip attachable to one of the plurality of attachment positions of the first rail, and a second rail having a plurality of attachment positions for a second clip attachable to one of the plurality of attachment positions of the second rail.

In examples, the respective first and second rails are arranged to support a front of the shelf.

In examples, the respective first and second rails are arranged to support a side of the shelf.

In examples, the first rail is arranged to support one of the front and side of the shelf, and the second rail is arranged to support the other of the front and side of the shelf.

In examples, the second shelf support is disposed on or adjacent to a doorpost at the front of the cabinet.

In examples, the first shelf support extends partially over the height of the rear of the cabinet. In examples, the first shelf support extends only partially over the height of the rear of the cabinet. In examples, ends of the first shelf support are spaced from a top and bottom of the cabinet. In examples, the first shelf support is disposed over a middle section of the height of the rear of the cabinet. This increases the available space within the refrigerator appliance.

In examples, the panel is an insulated panel.

In examples, comprising a moulding that extends across the rear side of the cabinet, and wherein the first shelf support is formed on the moulding. In examples, the moulding further extends across the top and/or bottom of the cabinet. In examples, the moulding further extends around at least one side of the cabinet.

In examples, the second shelf support is spaced from the first shelf support along a direction perpendicular to the plane of the door. In examples, the second shelf support is spaced from the first shelf support along a horizontal direction.

In examples, the rail extends vertically. In examples, the rail extends along a direction parallel to the plane of the door.

In examples, the plurality of attachment positions are provided by openings in the rail.

In examples, the refrigerator appliance further comprises a clip (for example the clip), and wherein the clip comprises two protruding arms. In examples, each arm is attachable to an opening in the rail.

In examples, the first shelf support extends across the width of the rear side of the cabinet.

In examples, the first shelf support extends partially across the width of the rear side of the cabinet. This increases the available space within the refrigerator appliance.

In examples, the first shelf support comprises a first support portion at a first side and a second support portion spaced apart from the first support portion at a second side. This further increases the space available within the refrigerator appliance.

In examples, the refrigerator appliance is a back bar refrigerator appliance. A back bar refrigerator appliance is typically sized to fit within a cavity or recess behind a bar, for example under a worksurface and/or between opposing walls.

BRIEF DESCRIPTION OF THE DRAWINGS

Embodiments of the invention are now described, by way of example only, hereinafter with reference to the accompanying drawings, in which:

(FIG. 5A) in a first configuration; (FIG. 5B) in a second configuration; (FIG. 5C) in a third configuration; and (FIG. 5D) in a fourth configuration;

(FIG. 6A) in a first configuration, and (FIG. 6B) in a second configuration.

DETAILED DESCRIPTION

Figure 1:
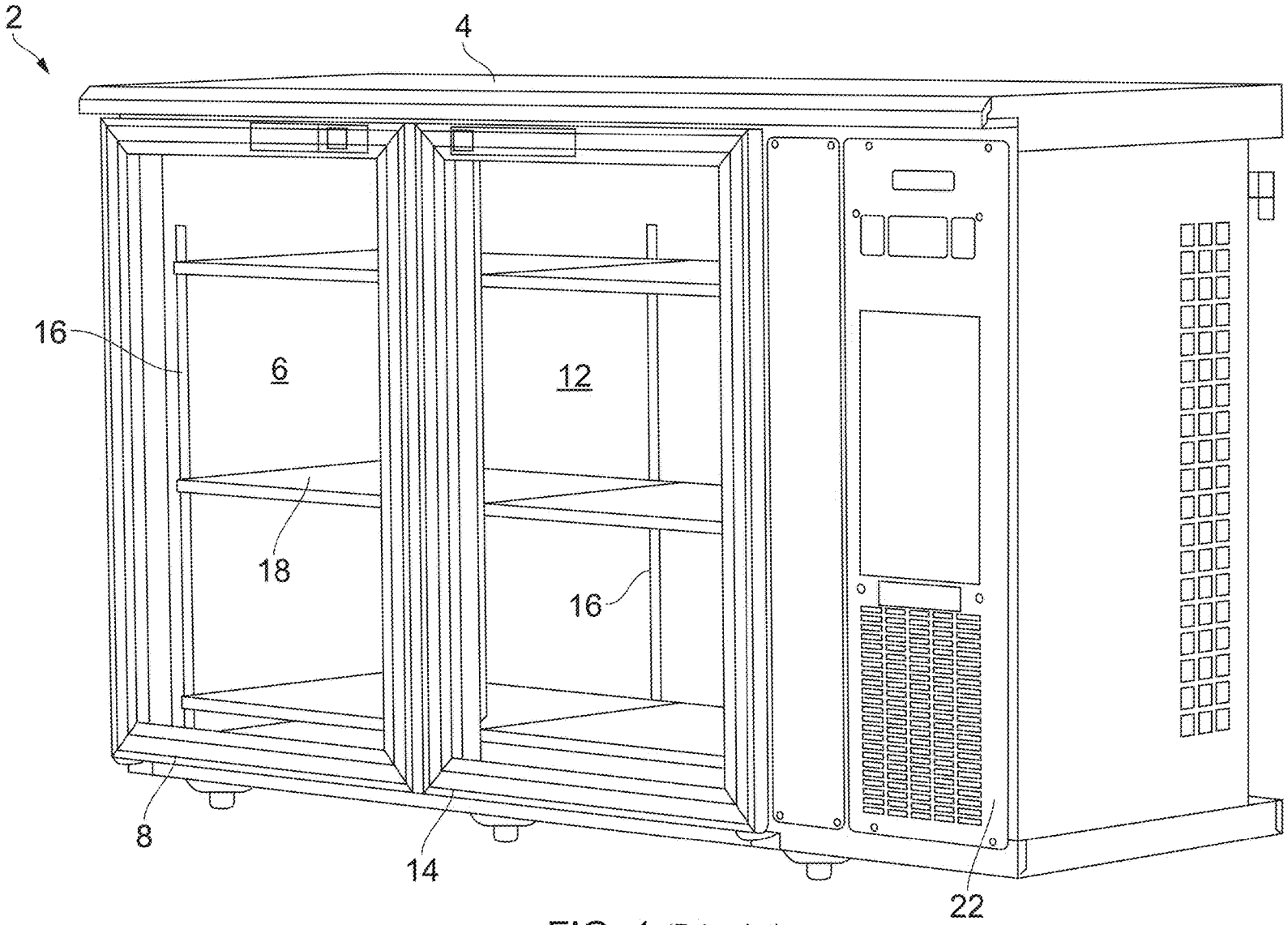
FIG. 1 (Prior Art)
FIG. 1 illustrates a perspective view of a known refrigerator appliance.

Certain terminology is used in the following description for convenience only and is not limiting. The words 'right', 'left', 'lower', 'upper', 'front', 'rear', 'upward', 'down' and 'downward' designate directions in the drawings to which reference is made and are with respect to the described component when assembled and mounted. The words 'inner', 'inwardly' and 'outer', 'outwardly' refer to directions toward and away from, respectively, a designated centreline or a geometric centre of an element being described (e.g. central axis), the particular meaning being readily apparent from the context of the description.

Further, as used herein, the terms 'connected', 'attached', 'coupled', 'mounted' are intended to include direct connections between two members without any other members interposed therebetween, as well as, indirect connections between members in which one or more other members are interposed therebetween. The terminology includes the words specifically mentioned above, derivatives thereof, and words of similar import.

Further, unless otherwise specified, the use of ordinal adjectives, such as, "first", "second", "third" etc. merely indicate that different instances of like objects are being referred to and are not intended to imply that the objects so described must be in a given sequence, either temporally, spatially, in ranking or in any other manner.

Like reference numerals are used to depict like features throughout.

Figure 2:
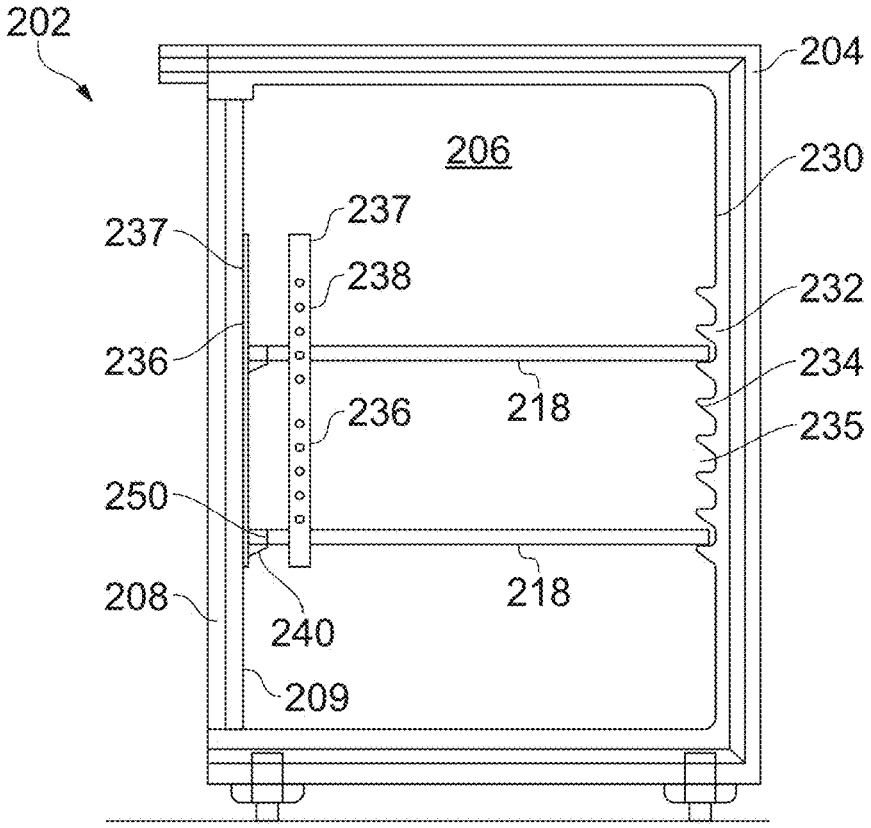
FIG. 2 illustrates a schematic representation of a refrigerator appliance.

Referring now to FIG. 2, there is shown a refrigerator appliance 202. The refrigerator appliance 202 has a cabinet 206 housed within a frame 204, and a door 208 at the front. The cabinet 206 has a cuboid shaped interior, having a rear side and an interior side 209 of the door 208 opposite the rear side of the cabinet 206. The rear side of the cabinet has a panel 230, with an integrally moulded first shelf support 232. The panel 230 may be insulated. The panel 230 may be a portion of a moulding that extends around the sides, the top and the bottom of the cabinet 206. In this example, the first shelf support 232 has a plurality of integrally moulded support surfaces 234. The support surfaces 234 are separated by recesses 235 disposed in between adjacent support surfaces 234. The first shelf support 232 may be made of a polymer. A thermoforming process may be used to form the pattern of support surfaces 234 on the panel 230. The refrigerator appliance 202 may be a back bar refrigerator appliance.

The refrigerator appliance 202 has a second shelf support 236 that is spaced apart from the first shelf support 232 in the cabinet 206. The second shelf support 236 has a rail 237 with multiple attachment positions 238 (e.g. openings), and a clip 240 that is attachable to one of the attachment positions 238 so that the clip 240 can support a shelf 218. When assembled, the rear end (219, FIG. 4) of the shelf 218 is supported by the first shelf support 232 at the rear side of the cabinet 206, and the shelf 218 is supported by the second shelf support 236 on the other side (221, FIG. 4). In particular, the clip 240 is attached to one of the attachment positions 238 of the rail 237, so that the shelf 218 is supported by the second shelf support 236 at a position away from the first shelf support 232. In this example, a fastener 250 is inserted through the shelf 218 and the clip 240 to hold the shelf 218 in place. Although the second shelf support 236 directly engages with and supports the shelf 218 in this example, it is envisaged that the second shelf support 236 may indirectly support the shelf 218. For example, the second shelf support 236 may support a horizontal rail (278, FIG. 3), on which the panel 218 is supported. In this example, separate second shelf supports 236 support the shelf 218 at the front of the shelf 218, and at the side of the shelf 218.

Figure 3:
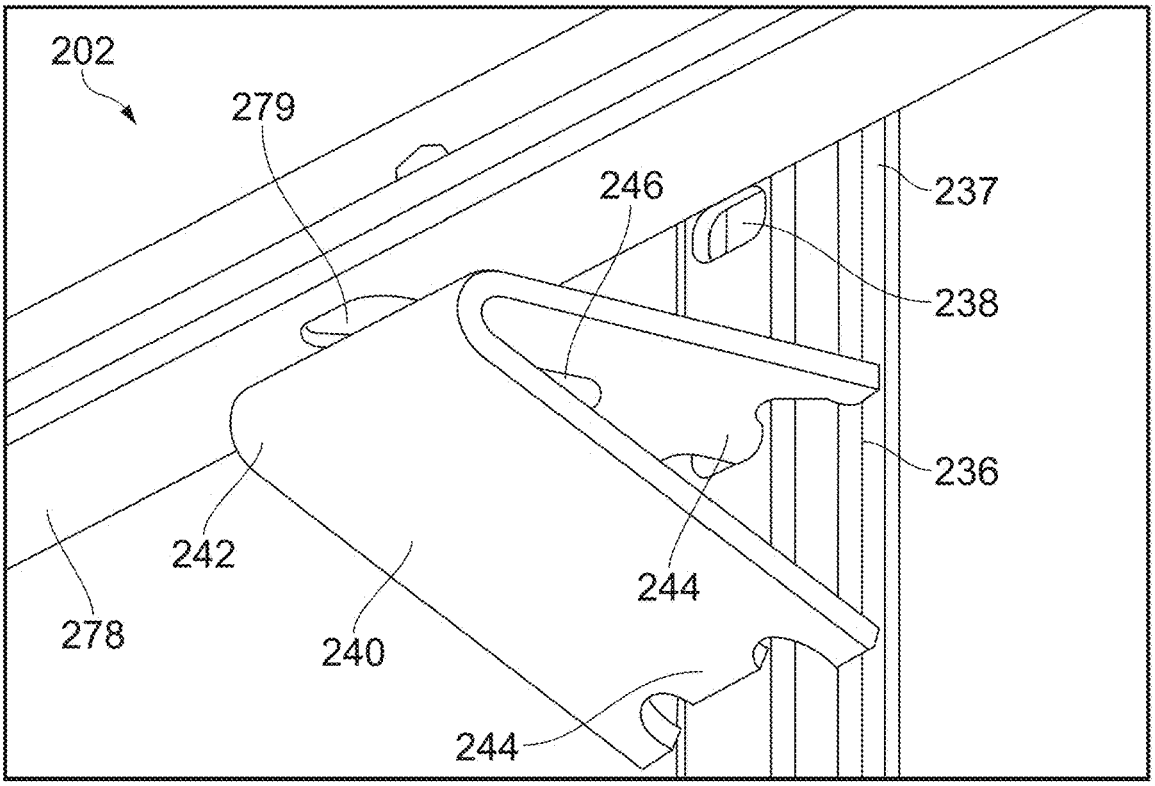
FIG. 3 illustrates the attachment of a clip on a rail for supporting a shelf.

FIG. 3 shows the second shelf support 236 in more detail. The second shelf support 236 has a rail 237 having a plurality of openings 238 along the length of the rail 237. The rail 237 is held vertically. A clip 240 is provided that has a bend 242, making the clip 240 V-shaped. Each end of the clip 240 has a protruding arm 244 that is inserted through an opening 238 of the rail to hold the clip 240 in place relative to the rail 237. The clip 240 has an aperture 246 that aligns with an aperture 279 of a horizontal rail 278. A fastener 250 can be inserted through the apertures 246,279 of the respective clip 240 and horizontal rail 278 to hold the clip 240 and rail 278 together. A shelf 218 can then be supported by the horizontal rail 278. Although the clip 240 is held on the rail 236 to support the horizontal rail 278 in this example, the clip 240 may instead support the shelf 218 directly.

Figure 4:
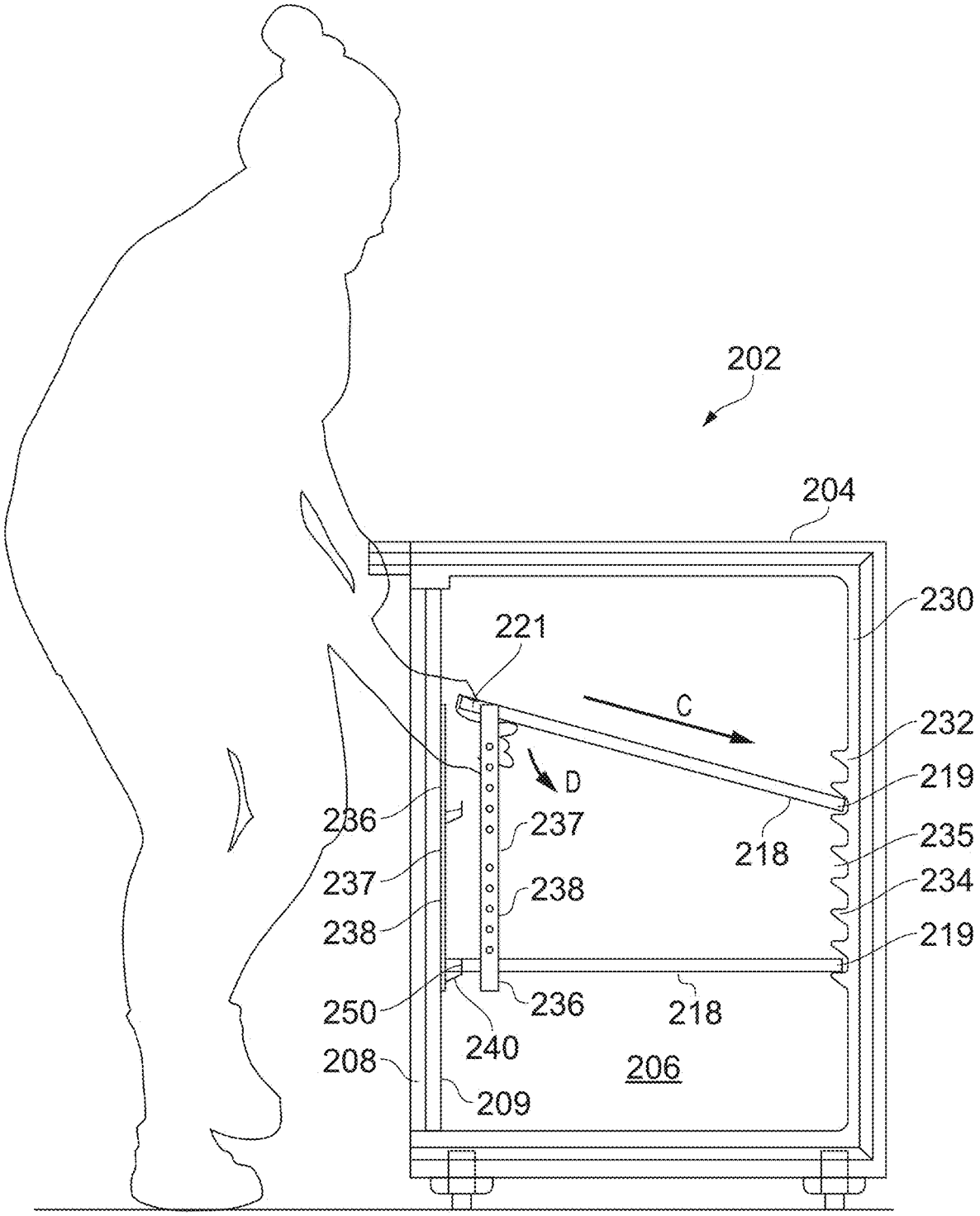
FIG. 4 illustrates a schematic representation of the refrigerator appliance of FIG. 2, showing the installation of a shelf.

FIG. 4 shows the installation of a shelf 218 into the cabinet 206 of the refrigerator appliance 202. A panel 218 is inserted through the door 208 from the front of the refrigerator appliance 202 in a direction denoted by the arrow 'C', so that a rear side 219 of the shelf 218 is supported by the first shelf support 232 at the rear side of the cabinet 206. A front side 221 of the shelf 218 is then lowered in a direction denoted by the arrow 'D', to be supported by the second shelf support 236. The recesses 235 provided in the first shelf support 232 may extend upwards. The recesses 235 are sized and shaped to receive the shelf 218. The shelf 218 is supported at its front 221 or side by a clip 240 that is held in the vertical rail 237. A fastener is provided 250 to fasten the clip 240 and the shelf 218 together at attachment positions 238 provided in the rail 237. In this example, the attachment positions 238 of the vertical rail 237 are aligned with support surfaces 234 of the first shelf support 232 so that the shelf 218 is held in a horizontal position when installed. The second shelf support 236 may be provided at the front of the cabinet 206, for example on an interior surface 209 of the door 208. The second shelf support 236 may instead or additionally be provided on a side surface of the cabinet 206. In this example, the first shelf support 232 extends partially over the height of the rear side of the cabinet 206. The first shelf support 232 may extend over a middle section of the rear side of the cabinet 206.

Figure 5A:
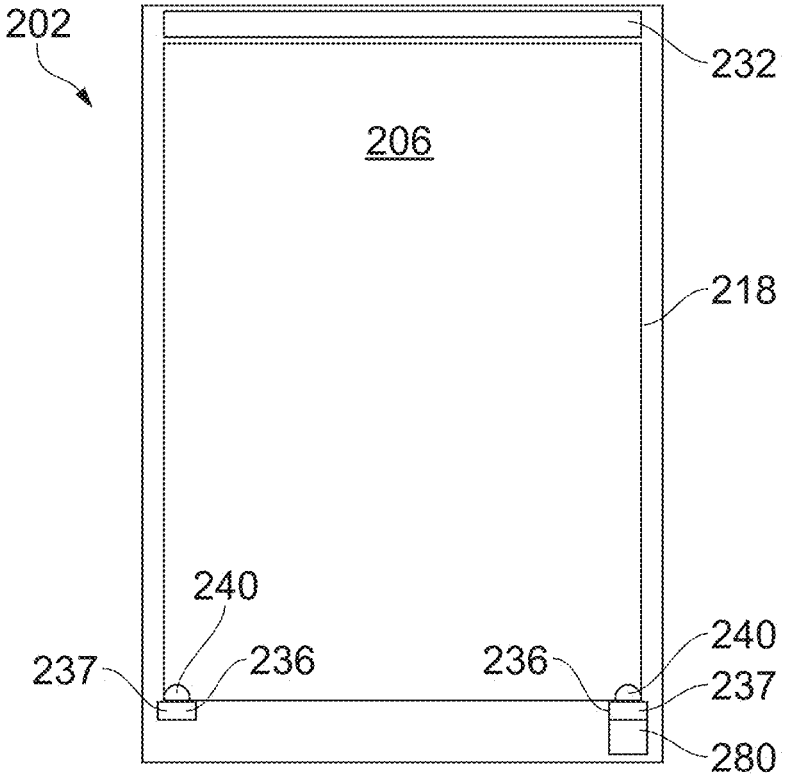
FIGS. 5A-5D illustrate a schematic representation of a refrigerator appliance, showing the arrangement clips and rails.
Figure 5B:
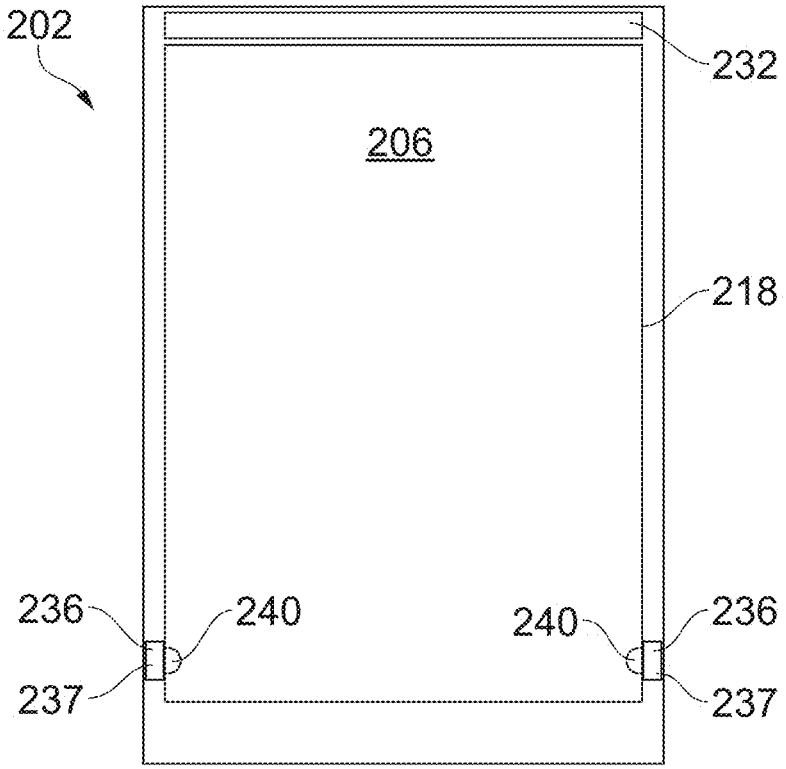
Figure 5C:
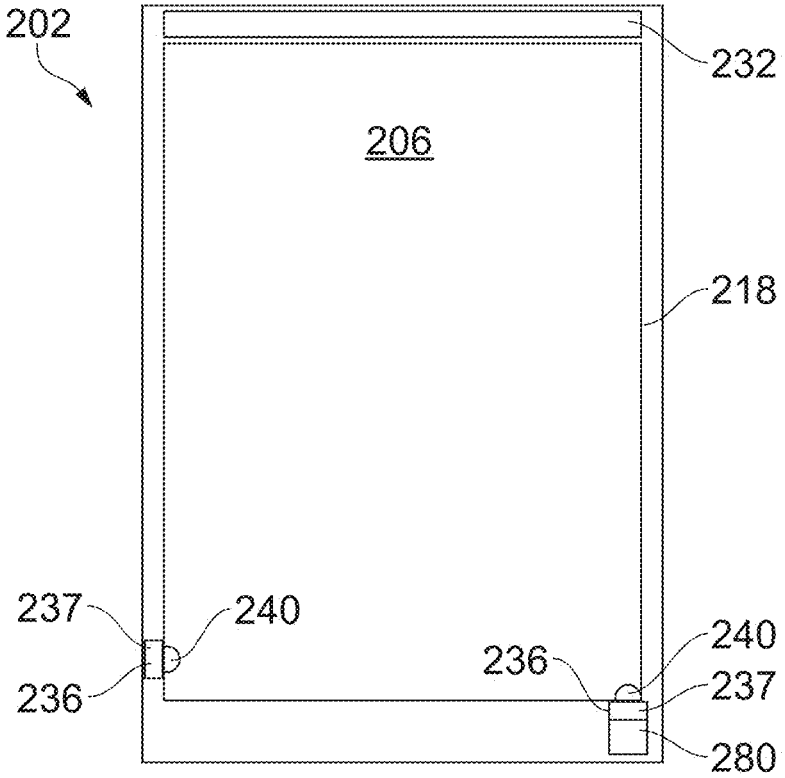
Figure 5D:
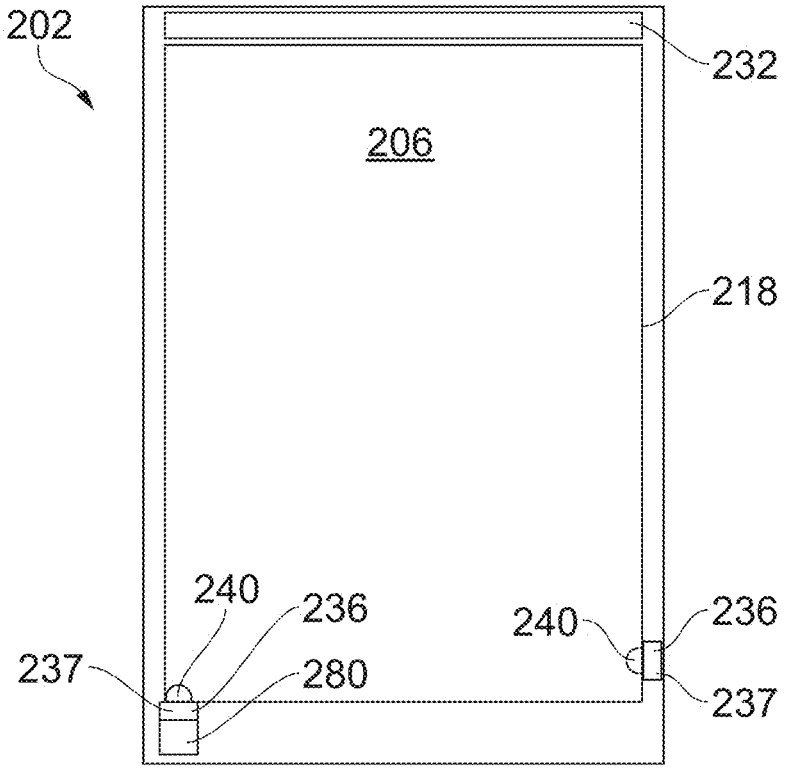

As shown in FIGS. 5A-5D, the second shelf support 236 may be arranged to support a front and/or the side of the shelf 218. FIG. 5A shows second shelf supports 236 that support the front of the shelf 218 at each side. One of the second shelf supports 236 is provided next to a doorpost 280 of the refrigerator appliance 202. FIG. 5B shows second shelf supports 236 that support opposing sides of the shelf 218. FIG. 5C shows one second shelf support 236 that supports a left side of the shelf 218, and another second shelf support 236 that supports a front of the shelf 218 on the right. FIG. 5D shows a mirrored arrangement to that of FIG. 5C, such that one second shelf support 236 supports a right side of the shelf 218, and another second shelf support 236 supports a front side of the shelf 218 on the left. Different arrangements of the second shelf support 236 are envisaged, depending on the desired layout of the cabinet 206 of the refrigerator appliance 202.

Figure 6A:
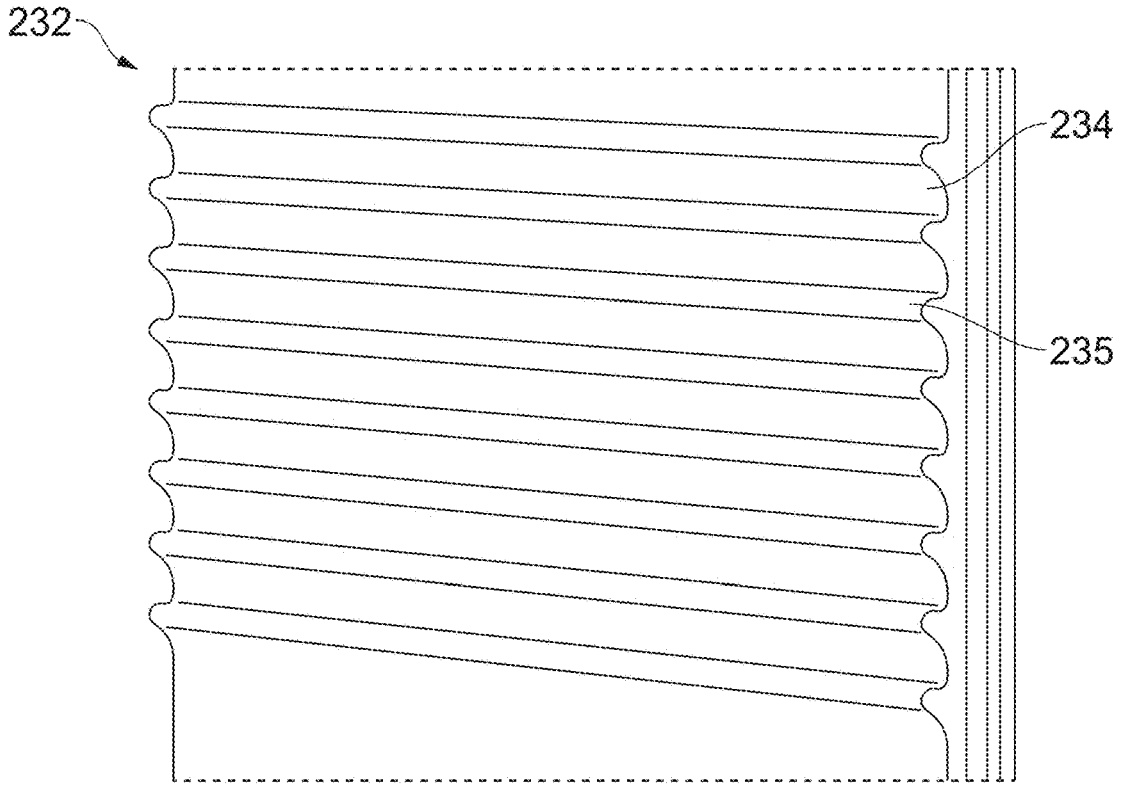
FIGS. 6A-6B illustrate a perspective view of a first shelf support on a back panel of a refrigerator appliance.
Figure 6B:
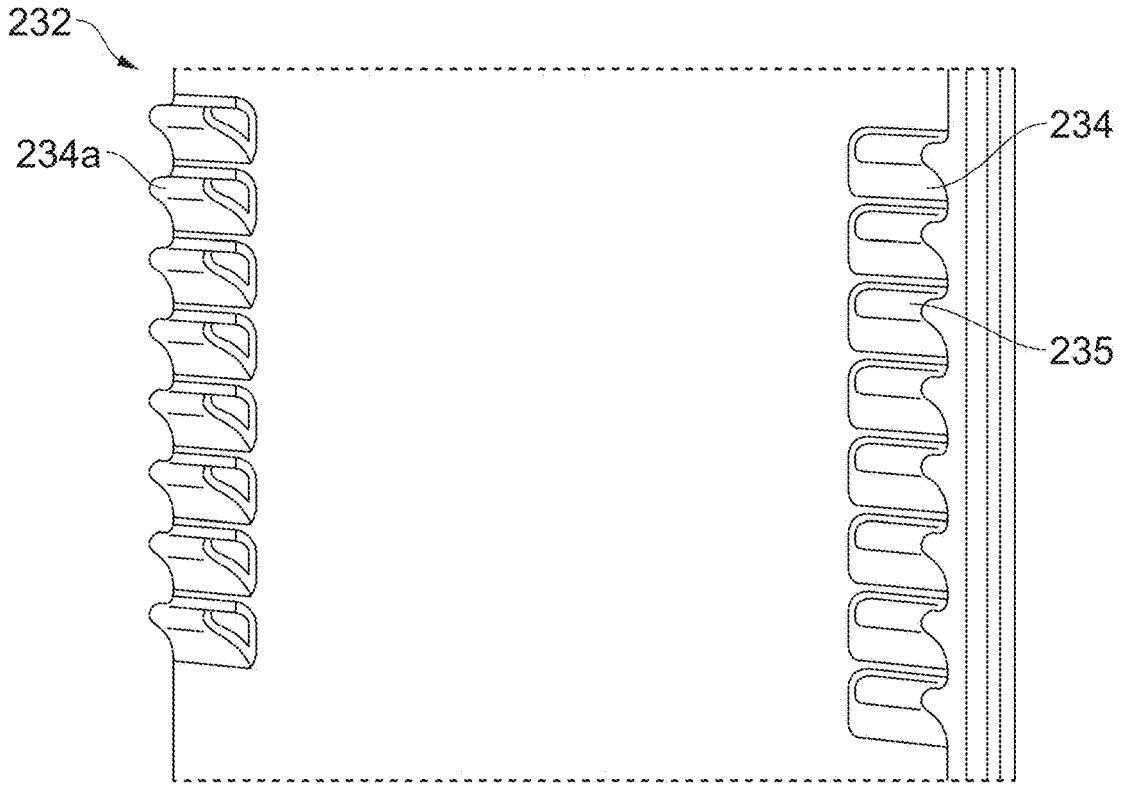

FIGS. 6A-6D shows the first shelf support 232 in more detail. The first shelf support 232 is integrally moulded and provided on a rear side of the refrigerator cabinet 206. FIG. 6A shows a first arrangement of the first shelf support 232 that extends across the entire width of the rear side of the cabinet 206. This arrangement improves insulation within the cabinet 206. The first shelf support 232 has a plurality of integrally moulded support surfaces 234 and recesses 235 separating the support surfaces 234. FIG. 6B shows a different arrangement in which the first shelf support 232 does not extend across the entire width of the rear side of the cabinet 206. Instead, the first shelf support 232 has a first support portion 234*a* on one side, and a second support portion 234*b* on the other side that is spaced apart from the first support portion 234*b*. This arrangement is advantageous because it increases the available space inside the refrigerator appliance 202.

It will be appreciated by persons skilled in the art that the above detailed examples have been described by way of example only and not in any limitative sense, and that various alterations and modifications are possible without departing from the scope of the invention as defined by the appended claims. Various modifications to the detailed examples described above are possible.

Through the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract or drawings), or to any novel one, or any novel combination, of the steps of any method or process so disclosed.

It will be appreciated by persons skilled in the art that the above embodiment(s) have been described by way of example only and not in any limitative sense, and that various alterations and modifications are possible without departing from the scope of the invention as defined by the appended claims. Various modifications to the detailed designs as described above are possible.

The invention claimed is:

1. A refrigerator appliance, comprising:

a cabinet comprising a rear side and a door opposite the rear side at a front of the cabinet;

a panel forming the rear side of the cabinet and comprising an integrally moulded first shelf support for supporting a rear end of a shelf; and a second shelf support spaced from the first shelf support and arranged to support a front and/or side of the shelf;

wherein the second shelf support comprises a first rail having a plurality of attachment positions for a first clip attachable to one of the plurality of attachment positions of the first rail, and a second rail having a plurality of attachment positions for a second clip attachable to one of the plurality of attachment positions of the second rail, and wherein the plurality of attachment positions of the first rail are provided by openings in the first rail and the plurality of attachment positions of the second rail are provided by openings in the second rail.

2. A refrigerator appliance according to claim 1, wherein the first shelf support comprises a plurality of integrally moulded support surfaces.

3. A refrigerator appliance according to claim 2, wherein the heights of the support surfaces of the first shelf support correspond to the attachment positions of the second shelf support.

4. A refrigerator appliance according to claim 2, wherein the support surfaces include first and second support surfaces that are spaced apart by a recess shaped and sized for receiving the shelf.

5. A refrigerator appliance according to claim 1, wherein the respective first and second rails are arranged to support a front of the shelf.

6. A refrigerator appliance according to claim 1, wherein the respective first and second rails are arranged to support a side of the shelf.

7. A refrigerator appliance according to claim 1, wherein the first rail is arranged to support one of the front and side of the shelf, and the second rail is arranged to support the other of the front and side of the shelf.

8. A refrigerator appliance according to claim 1, wherein the second shelf support is disposed on or adjacent to a doorpost at the front of the cabinet.

9. A refrigerator appliance according to claim 1, wherein the first shelf support extends partially over the height of the rear side of the cabinet.

10. A refrigerator appliance according to claim 1, wherein ends of the first shelf support are spaced from a top and bottom of the cabinet.

11. A refrigerator appliance according to claim 1, wherein the panel is an insulated panel.

12. A refrigerator appliance according to claim 1, comprising a moulding that extends across the rear side of the cabinet, and wherein the first shelf support is formed on the moulding.

13. A refrigerator appliance according to claim 12, wherein the moulding further extends across the top and/or bottom of the cabinet.

14. A refrigerator appliance according to claim 12, wherein the moulding further extends around at least one side of the cabinet.

15. A refrigerator according to claim 1, wherein the first clip comprises two protruding arms, each arm being attachable to an one of the openings in the first rail.

16. A refrigerator appliance according to claim 1, wherein the first shelf support extends across the width of the rear side of the cabinet.

17. A refrigerator appliance according to claim 1, wherein the first shelf support extends partially across the width of the rear side of the cabinet.

18. A refrigerator appliance according to claim 1, wherein the first shelf support comprises a first support portion at a first side and a second support portion spaced apart from the first support portion at a second side.

19. A refrigerator appliance according to claim 1, wherein the refrigerator appliance is a back bar refrigerator appliance.

* * * * *